US009825416B2

(12) United States Patent
Wang et al.

(10) Patent No.: US 9,825,416 B2
(45) Date of Patent: Nov. 21, 2017

(54) COMPOSITE CONNECTOR

(71) Applicants: Pei-Lun Wang, Keelung (TW); Xinping Luo, Hengnan County (CN)

(72) Inventors: Pei-Lun Wang, Keelung (TW); Xinping Luo, Hengnan County (CN)

( * ) Notice: Subject to any disclaimer, the term of this patent is extended or adjusted under 35 U.S.C. 154(b) by 0 days.

(21) Appl. No.: 15/477,062

(22) Filed: Apr. 1, 2017

(65) Prior Publication Data

US 2017/0302045 A1 Oct. 19, 2017

(30) Foreign Application Priority Data

Apr. 13, 2016 (TW) ..... 105205143 U

(51) Int. Cl.

| | |
|---|---|
| ***H01R 24/00*** | (2011.01) |
| ***H01R 43/20*** | (2006.01) |
| ***H01R 13/52*** | (2006.01) |
| ***H01R 24/78*** | (2011.01) |
| ***H01R 13/432*** | (2006.01) |
| ***H01R 24/60*** | (2011.01) |
| ***H01R 24/38*** | (2011.01) |
| ***H01R 24/84*** | (2011.01) |

(52) U.S. Cl.

CPC ..... *H01R 43/205* (2013.01); *H01R 13/432* (2013.01); *H01R 13/5219* (2013.01); *H01R 23/26* (2013.01); *H01R 24/60* (2013.01); *H01R 24/78* (2013.01); *H01R 24/84* (2013.01)

(58) Field of Classification Search

CPC ..... H01R 23/02; H01R 24/60; H01R 24/62

USPC ..... 439/660, 607.07

See application file for complete search history.

(56) References Cited

U.S. PATENT DOCUMENTS

| | | | | |
|---|---|---|---|---|
| 7,249,978 | B1 * | 7/2007 | Ni | G06K 19/07 361/752 |
| 7,537,489 | B2 * | 5/2009 | Iranpour Feridani | G02B 6/3873 439/660 |
| 8,986,049 | B2 * | 3/2015 | Kamarauskas | H01R 13/2442 439/607.41 |
| 8,998,620 | B2 * | 4/2015 | Ni | H01R 12/71 361/737 |
| 2015/0014162 | A1 * | 1/2015 | Kim | G01N 27/3273 204/403.14 |

* cited by examiner

*Primary Examiner* — Phuong Dinh

(74) *Attorney, Agent, or Firm* — Chun-Ming Shih; HDLS IPR Services

(57) ABSTRACT

A composite connector includes an insulative base having a seat and a tongue plate extended forward from the seat, a first insulative board attached onto the seat and arranged in parallel to the tongue and on one side of the first surface, a plurality of first conductive terminal pieces located on an outer side of the first insulative board and away from the tongue, a second insulative board attached onto the base and arranged in parallel to the tongue plate and on one side of the second surface, a plurality of second conductive terminal pieces located on an outer side of the second insulative board and away from the tongue plate, and a plurality of first elastic connecting terminals arranged between the first surface and the first insulative board. Accordingly, the technical effect of transmission for multiple transmission interfaces is achieved.

13 Claims, 11 Drawing Sheets

COMPOSITE CONNECTOR

BACKGROUND OF THE INVENTION

Field of the Invention

The present invention is related to a connector, in particular, to a composite connector.

Description of Related Art

With its support for hot swamp and plug-and-play function, Universal Serial Bus (USB) has been widely adopted in various information and telecommunication products, including such as personal computer and mobile devices. In addition, most of the smartphones in the market nowadays use the socket of the standard of Micro USB such that the transmission cables with Micro USB have become the mainstream in the market.

Furthermore, Lightning is a specialized connector standard developed by Apple Computers. The plug of such type of connector adopts a symmetrical design such that the two upper and lower sides are disposed of the same pins. Consequently, regardless of which direct direction the user plugs the connector into the interface, one of the sets of the pins can connect to the pins in the base. As a result, Lightning is known to have the no restricted direction for its use. Accordingly, there is a need to integrate both the Micro USB with the existing Lightning connector into one in order to achieve the applicable of use for different types of transmission interfaces.

In view of the above, to achieve the objective, the inventor seeks to provide a reasonable design capable of effectively improving the aforementioned drawbacks after years of researches along with utilization of academic theories and principles.

SUMMARY OF THE INVENTION

An objective of the present invention is to provide a composite connector in order to achieve the technical effect of transmission for multiple transmission interfaces.

To achieve the aforementioned objective, the present invention provides a composite connector, comprising an insulative base, a first insulative board, a plurality of conductive terminal pieces, a second insulative board, a plurality of second conductive terminal pieces and a plurality of first elastic connecting terminals. The insulative base comprises a seat and a tongue plate extended forward from the seat, the tongue plane having a first surface and a second surface opposite from each other. The first insulative board is attached onto the seat and arranged parallel to the tongue and on one side of the first surface. The plurality of first conductive terminal pieces include one end located on a first outer side of the first insulative board and away from the tongue and another end extended through the seat. The second insulative board is attached onto the base and arranged parallel to the tongue plate and on one side of the second surface. The plurality of second conductive terminal pieces include one end located on a second outer side of the second insulative board and away from the tongue plate and another end extended through the seat. The plurality of first elastic connecting terminals includes one end arranged between the first surface and the first insulative board and another end extended through the seat.

In comparison to the known art, the composite connector of the present invention comprises the insulative base as well as the first insulative board and the second insulative board arranged parallel to each other on the two sides thereof, the plurality of first conductive terminals arranged on an outer side of the second insulative board away from the tongue plate, the plurality of first elastic connecting terminals arranged on one side of the tongue plate of the insulative base; in addition, the first and second conductive terminal pieces are arranged on the first insulative board and the second insulative board to match with the Lighting interface standard; furthermore, the plurality of first and/or second elastic connecting terminals are arranged on the tongue plate to match with the Micro USB interface standard. Accordingly, the present invention of composite connector with such integration of the Micro USB and Lighting interface thereon is able to achieve the technical effect of transmission for multiple transmission interfaces and the practical applications of the present invention is improved.

DETAILED DESCRIPTION OF THE INVENTION

The following provide a detailed description on the technical content of the present invention along with the accompanied drawings. However, it shall be understood that the drawings are provided for illustration purposes only rather than to limit the scope of the present invention.

Figure 1:
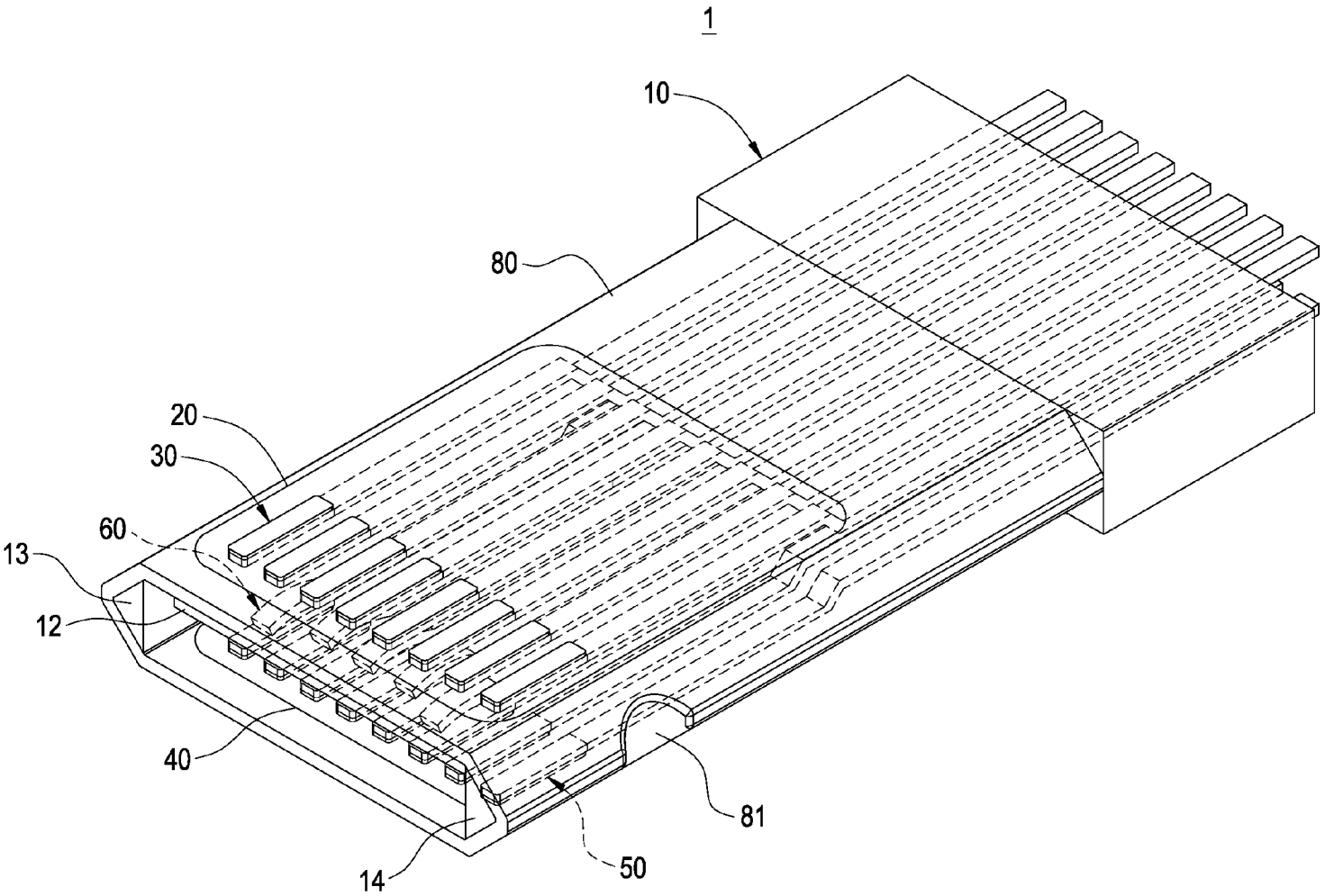
FIG. 1 is a perspective see-through view of a composite connector of the present invention.
Figure 2:
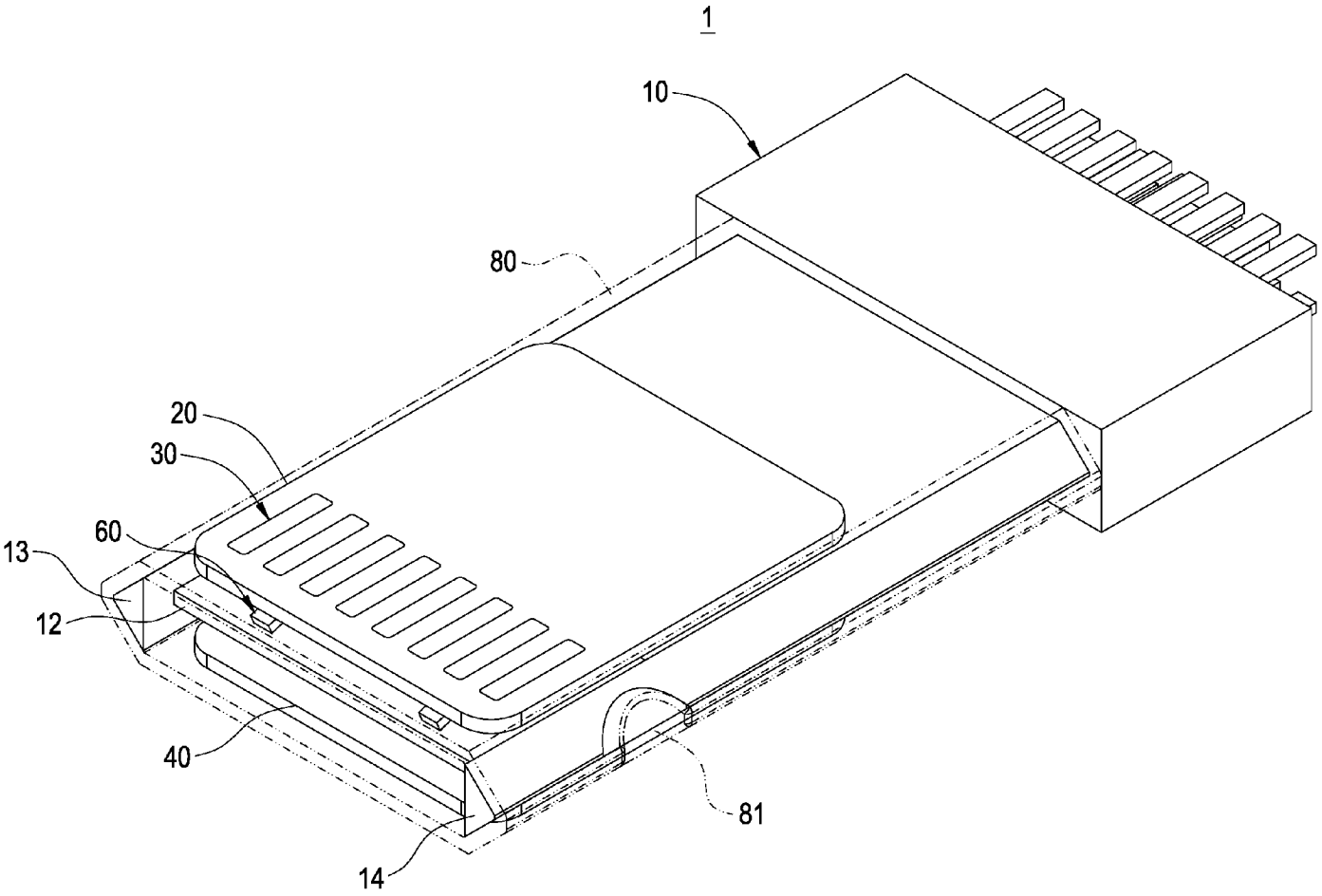
FIG. 2 is another perspective see-through view of the composite connector of the present invention.
Figure 3:
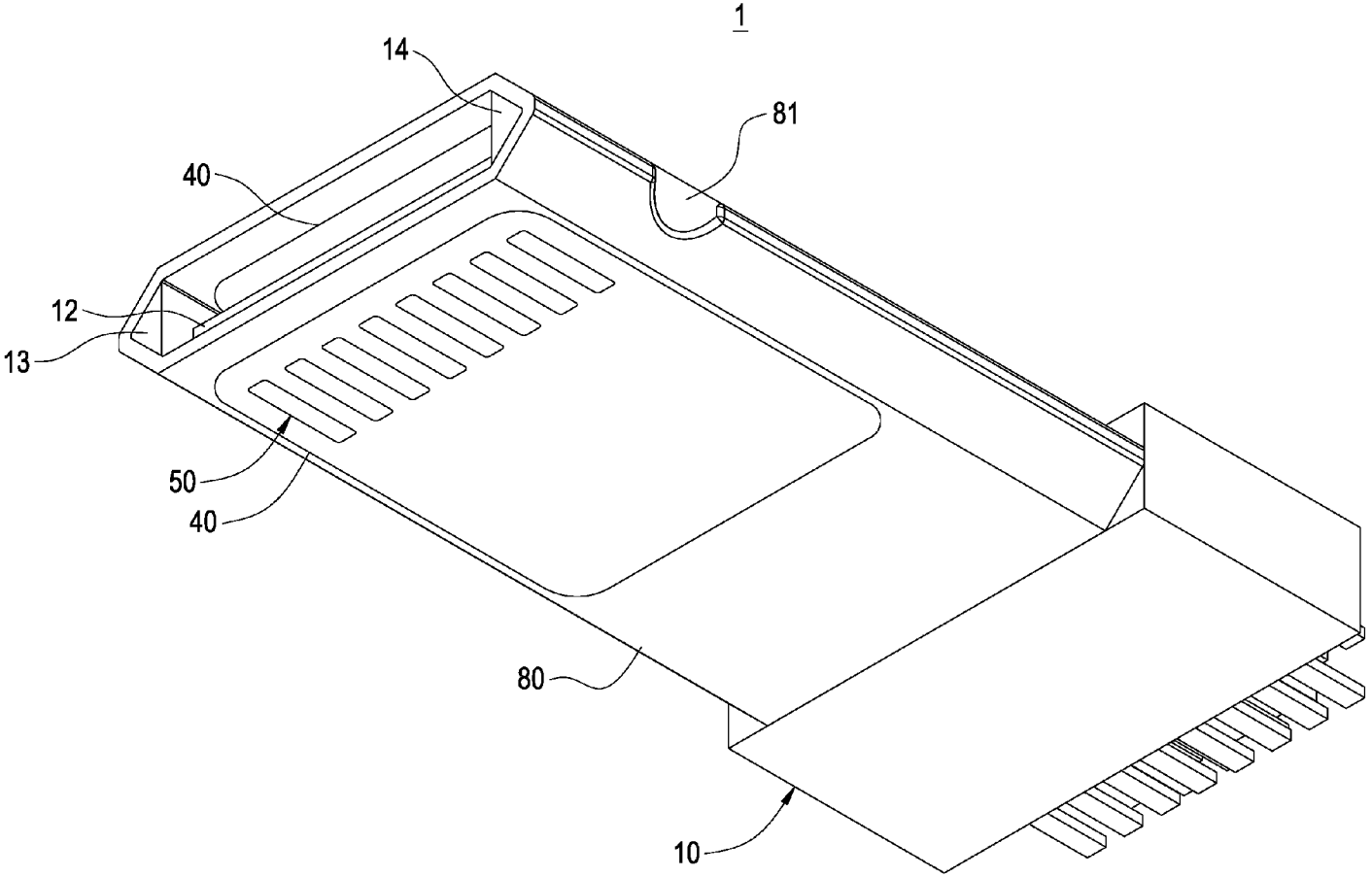
FIG. 3 is a perspective view of the composite connector of the present invention.
Figure 4:
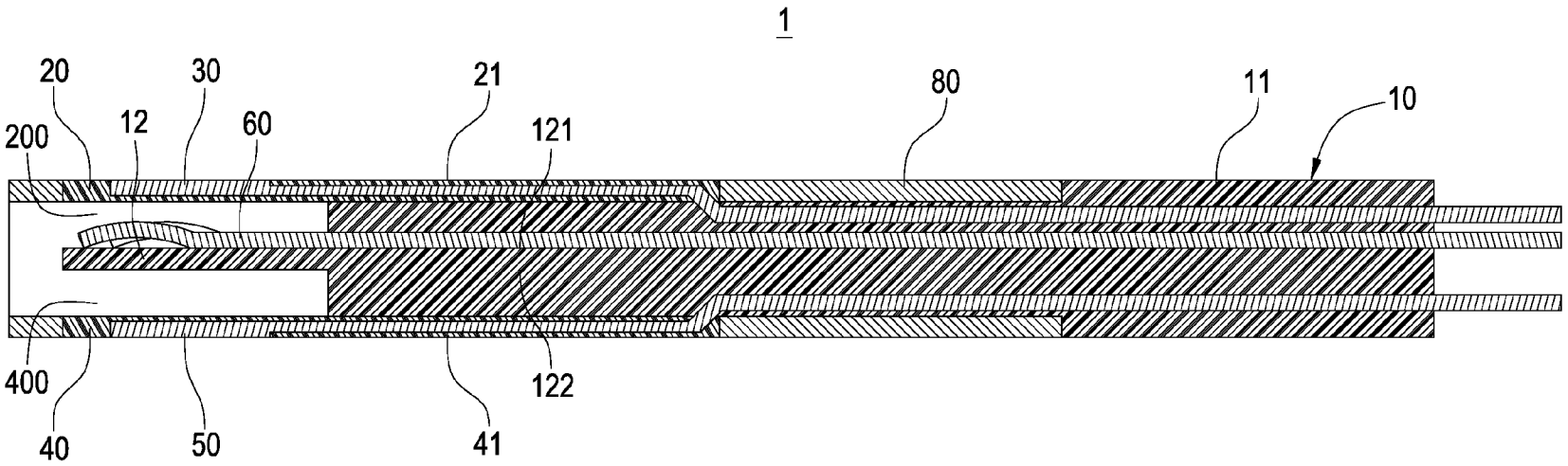
FIG. 4 is an assembly cross sectional view of the composite connector of the present invention viewed from one side.

Please refer to FIGS. 1 to 3, showing two perspective see-through views and perspective view of the composite connector of the present invention. The present invention provides a composite connector 1 comprising an insulative base 10, a first insulative board 20, a plurality of first conductive terminal pieces 30, a second insulative board 40, a plurality of second conductive terminals 50 and a plurality of first elastic connecting terminals 60. The first insulative board 20 and the second insulative board 40 are attached onto two sides of the insulative base 10. In addition, the plurality of first conducive terminal pieces 30 are arranged on the first insulative board 20, and the plurality of conductive terminal pieces 50 are arranged on the second insulative board 40. Moreover, the plurality of first elastic connecting terminals 60 are arranged between the plurality of first connective terminal pieces 30 and the plurality of second conductive terminal pieces 50. Accordingly, the composite connector 1 of the present invention is constructed.

The insulative base 10 comprises a seat 11 and a tongue plate 12 extended forward from the seat 11. The tongue plate 12 includes a first surface 121 and a second surface 122 opposite from each other.

The first insulative board 20 is attached onto the seat 11 and arranged parallel to the tongue plate 12 and on one side of the first surface 121. In addition, the plurality of first conductive terminal pieces 30 are arranged parallel to and spaced apart from each other. One end of the plurality of first conductive terminal pieces 30 is arranged on a first outer side 21 of the first insulative board 20 away from the tongue plate 12, and another end thereof extends through the seat 11.

Furthermore, the second insulative board 40 is attached onto the seat and arranged parallel to the tongue plate 12 and on one side of the second surface 122. In addition, the plurality of second conductive terminal pieces 50 are arranged parallel to and spaced apart from each other. One end of the plurality of second conductive terminal pieces 50 is arranged on a second outer side 41 of the second insulative board 40 away from the tongue plate 12, and another end thereof extends through the seat 11.

The plurality of first elastic connecting terminals 60 includes one end arranged between the first surface 121 of the tongue plate 12 and the first insulative board 20 and another end extended through the base 11.

To be more specific, the plurality of first conductive terminal pieces 30 are arranged on the first insulative board 20 to match with the Lighting interface standard; in addition, the plurality of second conductive terminal pieces 50 are also arranged on the second insulative board 40 to match with the Lighting interface standard Preferably, the plurality of first elastic connecting terminals 60 are arranged between the first insulative board 20 and the tongue plate 12 to match with the Micro USB interface standard.

In one embodiment of the present invention, the composite connector 1 further comprises a metal chassis 80. The metal chassis 80 covers the outer of the seat 11 and extends to enclose the outer perimeters of the first insulative board 20 and the second insulative board 40. In this embodiment, the metal chassis 80 includes a positioning slot 81 formed on the two sides of the tongue plate 12 respectively. To be more specific, the metal chassis 80 encloses to form a hexagonal column shape, and the metal chassis 80 exposes the plurality of first conductive terminal pieces 30 and the plurality of second conductive terminal pieces 50.

Figure 5:
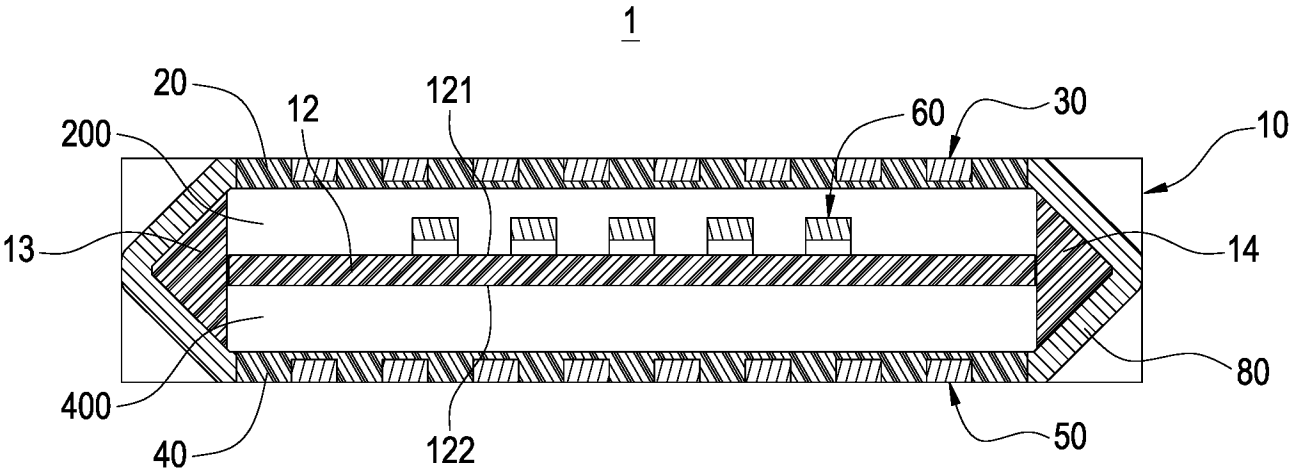
FIG. 5 is an assembly cross sectional view of the composite connector of the present invention viewed from another side.

Please refer to FIG. 5, showing another embodiment of the composite connector of the present invention. In this embodiment, the composite connector 1' further comprises a plurality of second elastic connecting terminals 70. The plurality of second elastic connecting terminals 70 includes one end arranged between the second surface 122 of the tongue plate 12 and the second insulative board 40 and another end extends through the base 11. In addition, the plurality of second elastic connecting terminals 70 are also arranged between the second insulative board 40 and the tongue plate 12 to match with the Micro USB interface standard. The configuration of the plurality of second elastic connecting terminals 70 is to allow the composite connector 1 to be reversely inserted with a Micro USB female connector.

Figure 6:
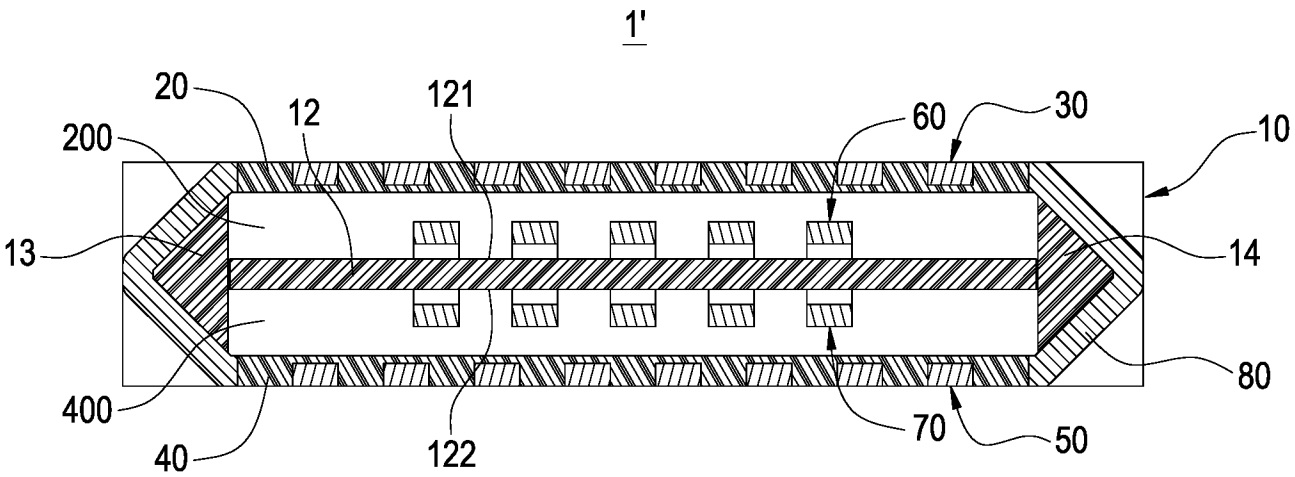
FIG. 6 shows another embodiment of a composite connector of the present invention.

Please refer to FIG. 5 and FIG. 6, showing assembly cross sectional views of the composite connector of the present invention viewed from two sides. As shown in FIG. 5, the composite connector 1' of the present invention mainly includes the plurality of first conductive terminal pieces 30 arranged on the first insulative board 20 to match with the Lightning interface standard; in addition, the plurality of second conductive terminal pieces 50 arranged on the second insulative board 40 to match with the Lightning interface standard. Moreover, the plurality of first elastic connecting terminal pieces 60 and the plurality of second elastic connecting terminals 70 are attached onto the two opposite sides of the tongue plate 12 to match with the Micro USB interface standard.

As shown in FIG. 5, it shall be noted that the plurality of first conductive terminal pieces 30, the plurality of second conductive terminal pieces 50, the plurality of first elastic connecting terminals 60 and the plurality of second elastic connecting terminals 70 penetrating through the seat 11 are arrange parallel to each other.

As shown in FIG. 6, the insulative base 10 further comprises a first blocking column 13 and a second blocking column 14 on two sides of the tongue plate 12. To be more specific, a first insertion opening 200 is formed among the first insulative board 20, the first blocking column 13, the tongue plate 12 and the second blocking column 14; in addition, a second insertion opening 400 is formed among the second insulative board 40, the first blocking column 13, the tongue plate 12 and the second blocking column 14. In this embodiment, the cross sections of the first blocking column 13 and the second blocking column 14 are of a triangular shape; however, the present invention is not limited to such shape only.

Figure 7:
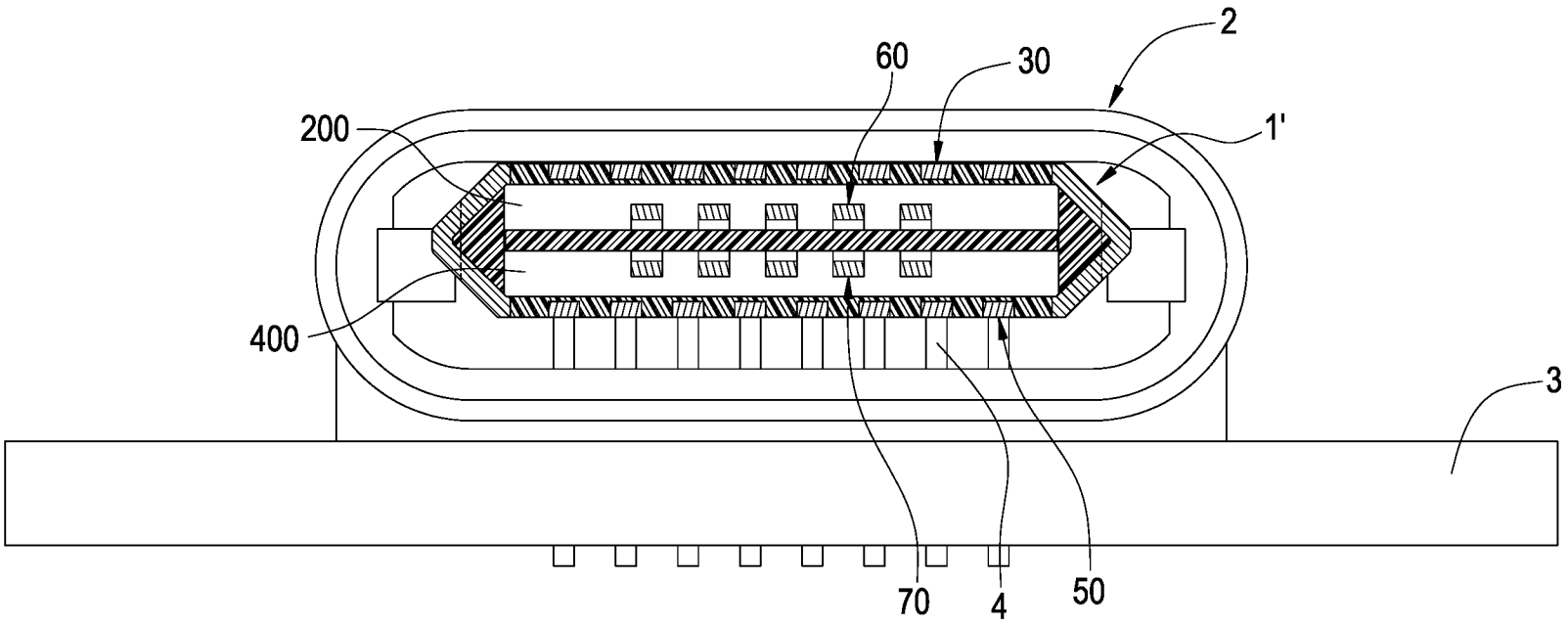
FIG. 7 is a cross sectional view showing the composite connector of the present invention inserted with a Lighting female plug connector.

Please refer to FIG. 7, showing a cross sectional view of the composite connector of the present invention inserted with a Lighting female plug connector. To be more specific, the first insulative board 20 of the composite connector 1' is provided for a Lightning female plug to be connected therein in order to electrically connect to the plurality of first conductive terminal pieces 30; in addition, the second insulative board 40 of the composite connector 1' is provided for a Lightning female plug to be connected therein in order to electrically connect to the plurality of second conductive terminal pieces 50

As shown in the figures, the composite connector 1' can be used for inserting with a Lighting connector 2, and the Lightning connector 2 includes a plurality of first pins 4 connected to a first circuit board 3. Once the composite connector 1' is inserted with the Lightning connector 2, the plurality of second conductive terminal pieces 50 underneath the composite connector 1' are electrically connected to the first pins 4 of the Lightning connector 2. Accordingly, the objective of signal transmission between the composite connector 1' and the Lightning connector 2 can be achieved.

It shall be noted that the composite connector 1' can also be inserted with the Lightning connector 2 in a reverse direction. At this time, the plurality of first conductive terminal pieces 30 on top of the composite connector 1' are electrically connected to the second pins 7 of the Lightning connector 2.

Figure 8:
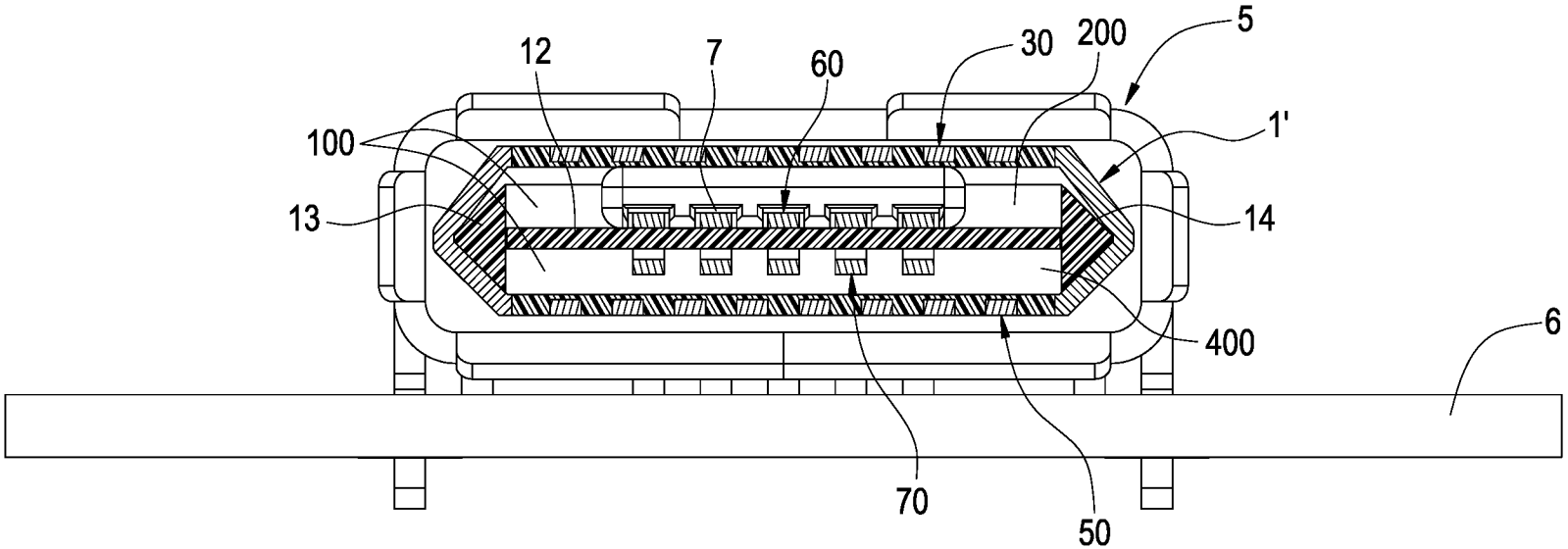
FIG. 8 is a cross sectional view showing the composite connector of the present invention inserted with a Micro USB female plug connector.
Figure 9:
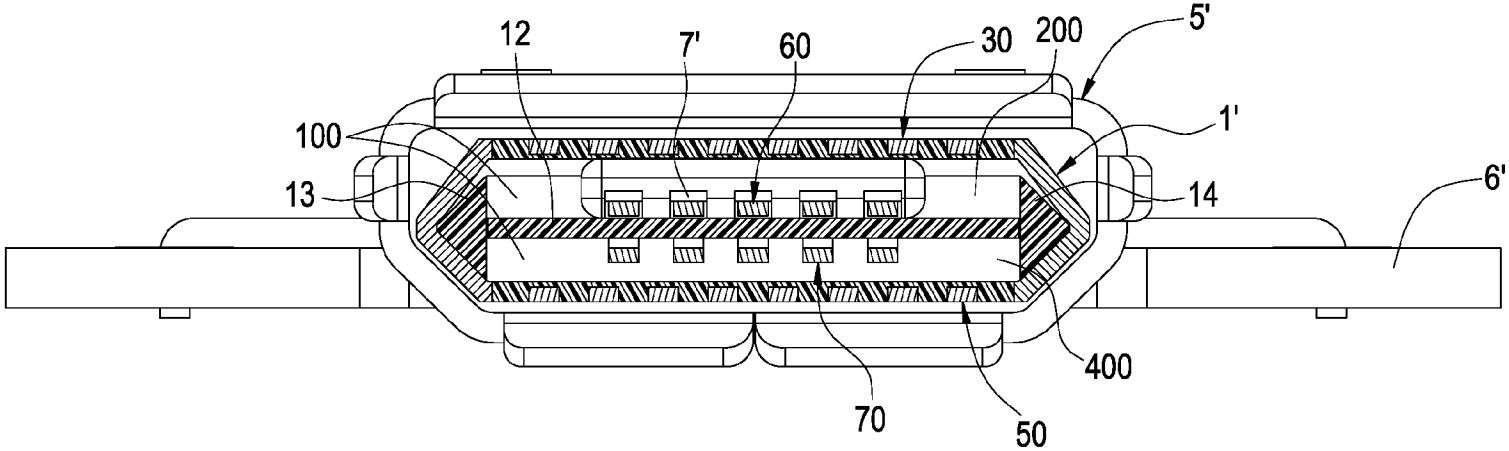
FIG. 9 is another cross sectional view showing the composite connector of the present invention inserted with a Micro USB female plug connector.

Please refer to FIG. 8 and FIG. 9, showing cross sectional views of the composite connector of the present invention connected with a Micro USB female plug connector. To be more specific, the first insertion opening 200 of the composite connector 1 is provided for a Micro USB female plug to be inserted therein in order to electrically connect to the plurality of first elastic connecting terminals 60; in addition, the second insertion opening 400 is provided for a Micro USB female plug to be inserted therein in order to electrically connect to the plurality of second elastic connecting terminals 70.

As shown in FIG. 8, the composite connector 1' can be used for inserting with a Micro-A type connector 5. The Micro-A type connector 5 includes a plurality of second pins 7 connected to a second circuit board 6. In this embodiment, the Micro-A type connector 5 is inserted into the first insertion opening 200 of the composite connector 1'. In other words, the plurality of first elastic connecting terminals 60 of the composite connector 1' are electrically connected to the second pins 7 of the Micro-A type connector 5. Accordingly, the objective of signal transmission between the composite connector 1' and the Micro-A type connector 5 can be achieved.

It shall be noted that the composite connector 1' can also be inserted with the Micro-A type connector 5 in a reverse direction. At this time, the plurality of second elastic connecting terminals 70 in the second insertion opening 400 of the composite connector 1' are electrically connected to the second pins 7 of the Micro-A type connector 5.

As shown in FIG. 9, the composite connector 1' can be used for inserting with a Micro-B type connector 5'. The Micro-B type connector 5' includes a plurality of second pins 7' connected to a second circuit board 6'. In this embodiment, the Micro-B type connector 5' is inserted into the first insertion opening 200 of the composite connector 1'. In other words, the plurality of first elastic connecting terminals 60 of the composite connector 1' are electrically connected to the second pins 7' of the Micro-B type connector 5'. Accordingly, the objective of signal transmission between the composite connector 1' and the Micro-B type connector 5' can be achieved.

It shall be noted that the composite connector 1' can also be inserted with the Micro-B type connector 5' in a reverse direction. At this time, the plurality of second elastic connecting terminals 70 in the second insertion opening 400 of the composite connector 1 'are electrically connected to the second pins 7' of the Micro-B type connector 5'.

It shall also be noted that when the composite connector 1' is inserted onto the Micro USB female plug with each other, a gap 100 is formed between the Micro USB female plug and the first insertion opening 200 or between the first blocking column 13 as well as the second blocking column 14 on two sides of the second insertion opening 400.

Figure 10:
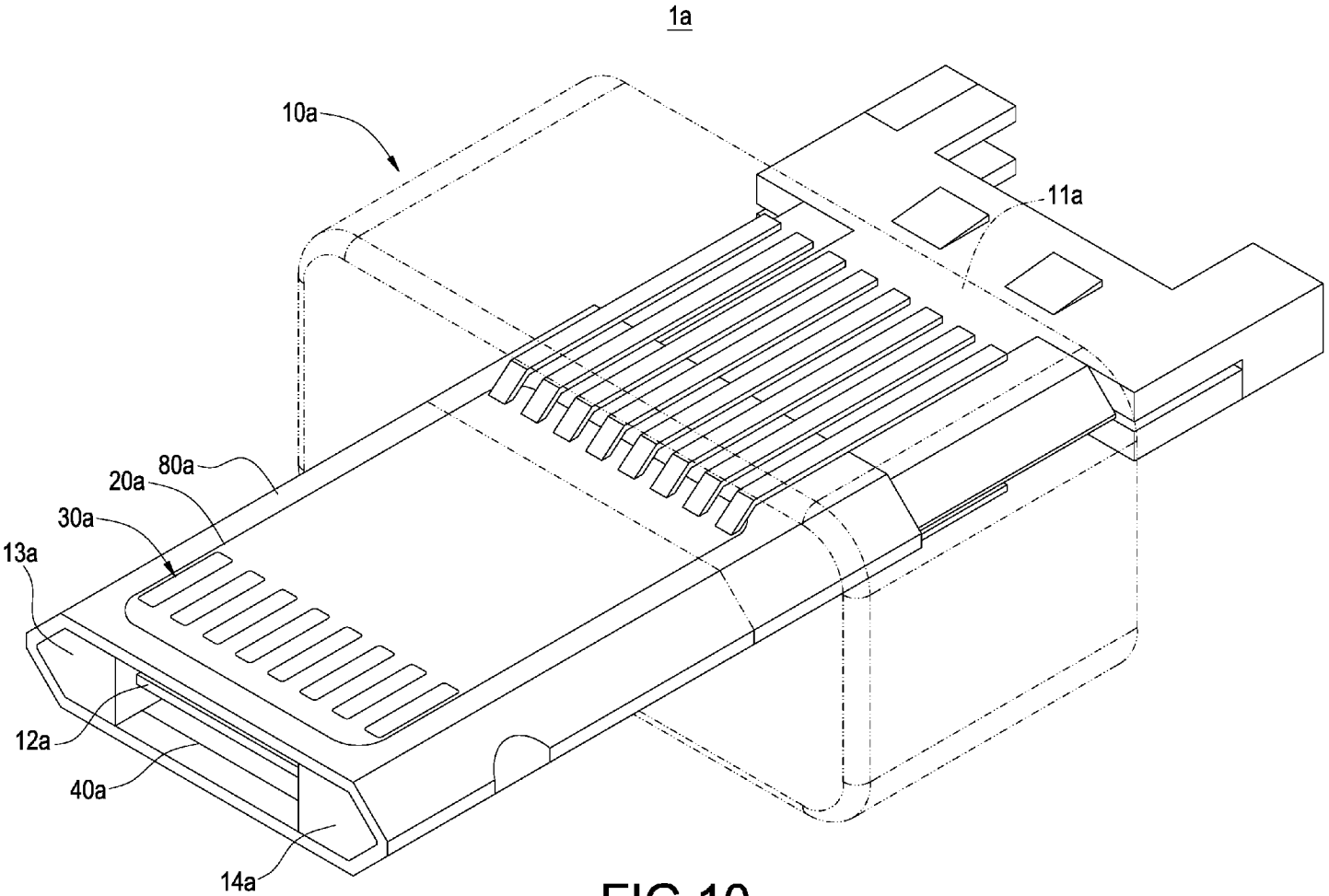
FIG. 10 is a perspective see-through view of a second embodiment of a composite connector of the present invention.
Figure 11:
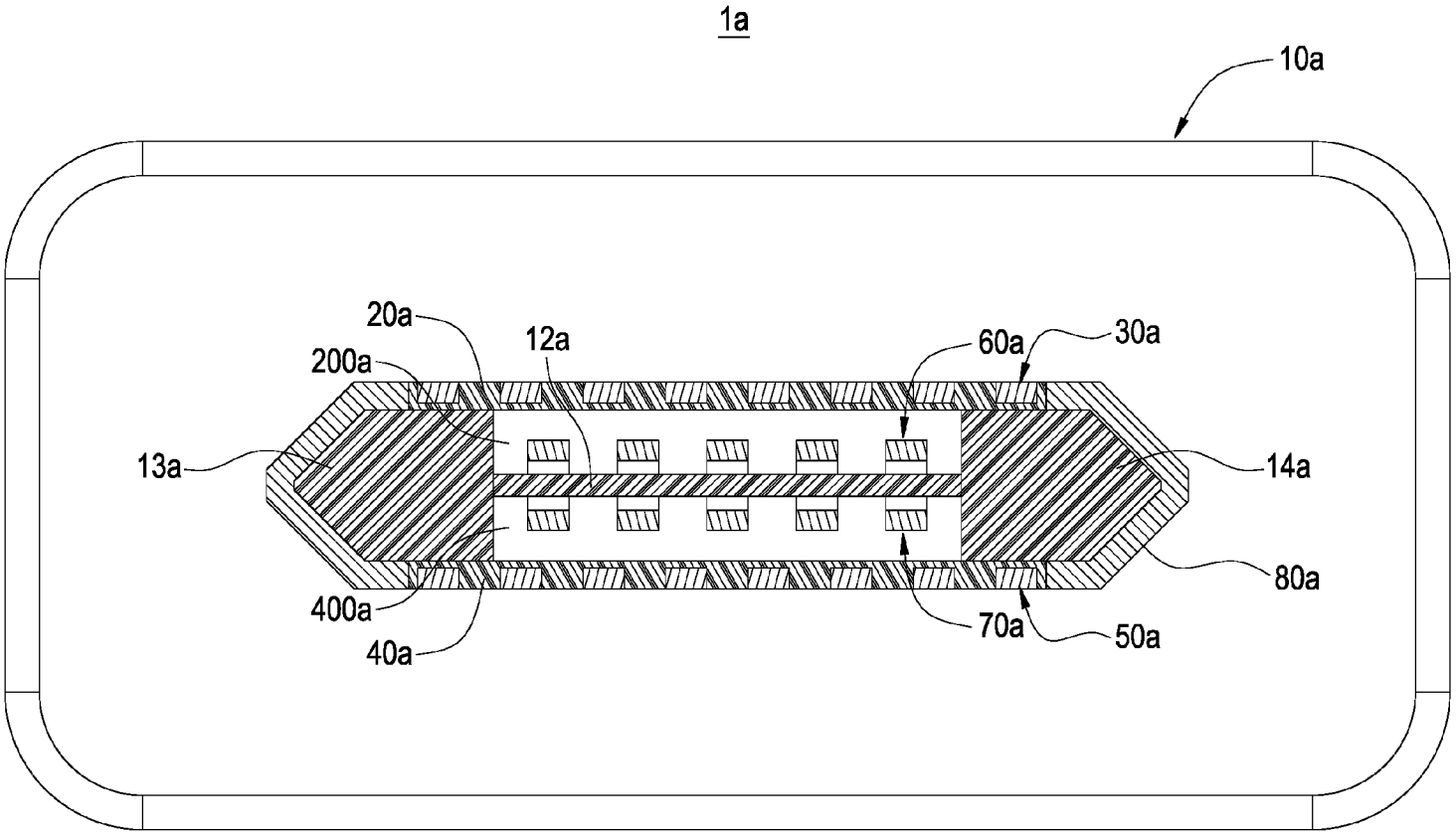
FIG. 11 is a cross sectional view of the second embodiment of a composite connector of the present invention.

Please refer to FIG. 10 and FIG. 11, showing a perspective view and a cross sectional view of a second embodiment of the composite connector of the present invention. This embodiment is generally identical to the first embodiment. The composite connector 1*a* comprises an insulative base 10*a*, a first insulative board 20*a*, a plurality of conductive terminal pieces 30*a*, a second insulative board 40*a*, a plurality of second conductive terminal pieces 50*a*, a plurality of elastic connecting terminals 60*a*, a plurality of second elastic connecting terminals 70*a* and a metal chassis 80*a*. In addition, the insulative base 10*a* comprises a seat 11*a* and a tongue plate 12*a*. Moreover, the insulative base 10 further comprises a first blocking column 13*a* and a second blocking column 14*a* extended on two sides of the tongue 12*a*. The different between the two embodiments relies in that the configuration of the first blocking column 13*a* and the second blocking column 14*a* in this embodiment.

To be more specific, a first insertion opening 200*a* is formed among the first insulative board 20*a*, the first blocking column 13*a*, the tongue plate 12*a* and the second blocking column 14*a*; in addition, a second insertion opening 400*a* is formed among the second insulative board 40*a*, the first blocking column 13*a*, the tongue plate 12*a* and the second blocking column 14*a*. In this embodiment, the cross sections of the first blocking column 13*a* and the second blocking column 14*a* are of a pentagonal shape. Moreover, the sizes of the first insertion opening 200*a* and the second insertion opening 400*a* are configured to match with a Micro USB female plug. In other words, when the composite connector 1*a* is inserted with the Micro USB female plug, the Micro USB female plug is able to abut against the first blocking column 13*a* and the second blocking column 14*a* on two sides of the first insertion opening 200*a* or the second insertion opening 400*a* in order to achieve a firm insertion and connection effect.

In view of the above, the retractable column structure of the present invention is able to achieve the expected objectives of use and to overcome the drawbacks of known arts. In addition, the above description is to illustrate the exemplary embodiments of the present invention only, which shall not be treated as limitations to the claims of the present invention, and other equivalent modifications utilizing the spirit of the patent of the present invention shall all be deemed to be within the scope of the claims of the present invention.

What is claimed is:

1. A composite connector, comprising:

an insulative base comprising a seat and a tongue plate extended forward from the seat, the tongue plane having a first surface and a second surface opposite with each other;

a first insulative board attached onto the seat and arranged in parallel to the tongue and on one side of the first surface;

a plurality of first conductive terminal pieces, each having one end located on a first outer side of the first insulative board and away from the tongue and another end extended through the seat;

a second insulative board attached onto the base and arranged in parallel to the tongue plate and on one side of the second surface;

a plurality of second conductive terminal pieces, each having one end located on a second outer side of the second insulative board and away from the tongue plate and another end extended through the seat; and a plurality of first elastic connecting terminals, each having one end arranged between the first surface and the first insulative board and another end extended through the seat.

2. The composite connector according to claim 1, wherein the plurality of first conductive terminal pieces are arranged on the first insulative board to match with a Lightning interface specification.

3. The composite connector according to claim 1, wherein the plurality of second conductive terminal pieces are arranged on the second insulative board to match with a Lightning interface specification.

4. The composite connector according to claim 1, wherein the plurality of first elastic connecting terminals are arranged between the first insulative board and the tongue plate to match with a Micro USB interface specification.

5. The composite connector according to claim 1, further comprising a plurality of second elastic connecting terminals, each having one end arranged between the second surface and the second insulative board and another end extended through the seat.

6. The composite connector according to claim 5, wherein the plurality of second elastic connecting terminals are arranged between the second insulative board and the tongue plate to match with a Micro USB interface specification.

7. The composite connector according to claim 1, further comprising a metal chassis, wherein the metal chassis covers an outer of the seat and extends forward to enclose outer perimeters of the first insulative board and the second insulative board.

8. The composite connector according to claim 7, wherein the metal chassis includes a positioning slot formed on each of two sides of the tongue plate.

9. The composite connector according to claim 7, wherein the metal chassis exposes the plurality of first conductive terminal pieces and the plurality of second conductive terminal pieces.

10. The composite connector according to claim 1, wherein the plurality of first conductive terminal pieces, the plurality of second conductive terminal pieces and the plurality of elastic connecting terminals penetrating through the seat are arranged in parallel to each other.

11. The composite connector according to claim 1, wherein the insulative base further comprises a first blocking column and a second blocking column; a first insertion opening is formed among the first insulative board, the first blocking column, the tongue plate and the second blocking column; a second insertion opening is formed among the second insulative boards, the first blocking column, the tongue plate and the second blocking column.

12. The composite connector according to claim 11, wherein the first insertion opening is configured to allow a Micro USB female plug to be inserted therein in order to connect to the plurality of first elastic connecting terminals, and the second insertion opening is configured to allow another Micro USB female plug to be inserted therein in order to connect to the plurality of second elastic connecting terminals.

13. The composite connector according to claim 11, wherein the first insulative board is configured to allow a Lightning female plug to be inserted therein in order to electrically connect to the plurality of first conductive terminal pieces, and the second insulative board is configured to allow another Lighting female plug to be inserted therein in order to electrically connect to the plurality of second conductive terminal pieces.

* * * * *